US006990792B2

(12) United States Patent
Katsumata et al.

(10) Patent No.: US 6,990,792 B2
(45) Date of Patent: Jan. 31, 2006

(54) CARTON BOTTOM FOLDING ASSEMBLY

(75) Inventors: Yoshiki Katsumata, Edina, MN (US); Dave McDonough, Dundee, IL (US); Masaaki Kawase, Edina, MN (US)

(73) Assignee: Tetra Laval Holdings & Finance, S.A., Pully (CH)

( * ) Notice: Subject to any disclaimer, the term of this patent is extended or adjusted under 35 U.S.C. 154(b) by 0 days.

(21) Appl. No.: 10/666,289

(22) Filed: Sep. 18, 2003

(65) Prior Publication Data

US 2005/0060965 A1 Mar. 24, 2005

(51) Int. Cl.
*B65B 43/26* (2006.01)

(52) U.S. Cl. ..... 53/565; 53/563; 493/165; 493/184

(58) Field of Classification Search ..... 53/563–565, 53/571; 493/165, 184, 151–153, 132, 141, 493/135, 183

See application file for complete search history.

(56) References Cited

U.S. PATENT DOCUMENTS

| | | | | |
|---|---|---|---|---|
| 3,187,647 | A | 6/1965 | Braun | |
| 3,602,106 | A | 8/1971 | Allen | |
| 3,789,746 | A * | 2/1974 | Martensson et al. | 53/563 |
| 4,589,862 | A * | 5/1986 | Murrah | 493/183 |
| 5,167,607 | A | 12/1992 | Larsen | |
| 5,234,398 | A | 8/1993 | Larsen | |
| 5,324,250 | A * | 6/1994 | Janson et al. | 493/133 |
| 5,538,491 | A | 7/1996 | Owen et al. | |
| 5,681,253 | A | 10/1997 | Owen et al. | |
| 6,182,417 | B1 | 2/2001 | Keopple | |
| 6,343,459 | B1 | 2/2002 | Seaward et al. | |
| 6,385,950 | B1 | 5/2002 | Anderson | |
| 6,387,028 | B1 | 5/2002 | Nishio et al. | |
| 6,560,950 | B1 | 5/2003 | Johansson | |
| 6,599,225 | B2 * | 7/2003 | Ammons et al. | 493/183 |
| 2001/0008252 | A1 | 7/2001 | Ammons et al. | |

* cited by examiner

FOREIGN PATENT DOCUMENTS

EP 0 460 844 A1 12/1991

*Primary Examiner*—Stephen F. Gerrity
*Assistant Examiner*—Thanh Truong
(74) *Attorney, Agent, or Firm*—Welsh & Katz, Ltd.

(57) ABSTRACT

A bottom folding assembly for a packaging machine is configured to infold the bottom side panels, leading panel and trailing panel of a carton for forming a sealed carton bottom in such a manner as to reduce the contact of rotating elements with the carton material to reduce the generation of dust. The bottom folding assembly is positioned about a rotating turret that defines a turret plane. The mandrels are configured to receive a carton in the tubular form and to carry the carton with the carton positioned such that a bottom of the carton is positioned at a free end of the mandrel. The bottom folding apparatus, located between a carton bottom heater and a carton bottom sealer includes a rotating drive shaft mounted transverse to the turret plane and a pair of opposing rotating members are operably mounted to the drive shaft and are disposed on either side of the turret rotational path. The rotating member rotate in a plane transverse to the turret plane. A tucking assembly is disposed between the opposing rotating members and is mounted to the drive shaft for rotating in a plane transverse to the rotating members and parallel to the turret plane. When a carton is positioned on the mandrel and passes the folding assembly, the opposing rotating members contact the bottom side wall flaps, urging the bottom side wall flaps inwardly, and the tucking assembly contacts the bottom trailing flap, urging the bottom trailing flap inwardly, over the bottom side wall flaps. A form, fill and seal machine having the bottom folding assembly is also disclosed.

9 Claims, 4 Drawing Sheets

CARTON BOTTOM FOLDING ASSEMBLY

BACKGROUND OF THE INVENTION

The present invention pertains to a folding device for carton bottoms. More particularly, the present invention pertains to an apparatus for in-folding, for sealing, over-folded carton bottoms.

A common form of container for milk, juice and the like is the gable top carton. In this regard, packaging technology has made enormous strides vis-à-vis these gable top cartons, as well as other types of packages. Present technology permits the packaging of perishable food items for non-refrigerated shelf lives that can be as much as 90 days. Such packages provide the ability to bring these food items into parts of the world that have limited transportation, distribution and storage infrastructure.

To this end, efforts have been directed to increasing the ability to maintain high levels of cleanliness in forming, filling and sealing these containers to provide the highest quality product and to provide the greatest product shelf life. And, in conjunction with this, the demands on packaging machines have become greater, in particular, relative to operating speeds. One packaging machine in which cartons or packages are formed, filled and sealed in a sterile environment by a single machine an operate at machine speeds that exceed 10,000 packages per hour.

In order to maintain the integrity of the package after it is filled and sealed, advanced technologies have been applied to the carton materials, as well as the processing operations. Many such packaging materials are formed from paperboard or fiberboard-based materials formed in a composite structure. Typically, one or more layers, such as polymeric coatings, foil coatings and the like, are applied to the paperboard or fiberboard substrate to reduce or eliminate the gas and liquid permeability of the substrate material.

In the form, fill and seal process, it has been observed that the contact of machine parts with the carton material tends to result in the generation of dust. This is particularly so when machine parts contact container material surfaces at relatively high rates of speed (e.g., when machine parts continuously contact container material surfaces relatively soon after the heating process, especially at the bottom forming and sealing process, in that the packaging material surface is easily scratched when the polymer surface is soft). For example, when machine parts (moving at a relative speed that is greater than the speed of the moving container) contact the container. One particular area in which this is observed is the bottom panel folding assembly.

Known bottom panel folding assemblies include a pair of spaced apart rotating hubs having multiple outwardly extending fingers. As the carton passes between the hubs, the fingers contact the flaps and fold over the flaps. Although this assembly works quite well to fold the flaps and to provide a well folded and sealed arrangement, it tends to generate a considerable amount of dust.

Accordingly, there exists a need for a carton bottom folding device for folding over-folded carton bottoms, which device can be used with known form, fill and seal machines. Desirably, such a folding device can accommodate carton folding operations at the operating speeds of known filling machines. Most desirably, the folding device carries out the folding operation while reducing the amount of dust generated.

BRIEF SUMMARY OF THE INVENTION

A bottom folding assembly for a packaging machine is configured to infold the bottom side panels, leading panel and trailing panel of a carton for forming a sealed carton bottom. The folding assembly reduces the contact of rotating elements with the carton material to reduce the generation of dust.

A packaging machine in which the bottom folding assembly is used includes a carton magazine for storing a plurality of cartons in a flat folded form, and a carton erection station for receiving the cartons and opening the cartons to a tubular form. A rotating turret is positioned for receiving the erected cartons. The turret rotates to define a turret plane.

A plurality of carton mandrels are mounted to the turret for rotation with the turret. Each mandrel is configured to receive the carton in the tubular form and to carry the carton with the carton positioned such that a bottom of the carton is positioned at a free end of the mandrel. The machine includes a carton bottom heater located along a rotational path of the turret and a carton bottom sealer located along the rotational path of the turret.

The bottom folding assembly is positioned between the heater and the sealer. The folding assembly includes a rotating drive shaft mounted transverse to the turret plane and spaced from a periphery of the turret path. A pair of opposing rotating members are disposed on either side of the rotational path of the turret and are operably mounted to the drive shaft. Each of the rotating members is configured to rotate in a plane that is transverse to the turret plane.

A tucking assembly is disposed between the opposing rotating members. The tucking assembly is mounted to the drive shaft for rotating in a plane transverse to the plane of the rotating members and parallel to the turret plane. When a carton is positioned on the mandrel and passes the folding assembly, the opposing rotating members contact the bottom side wall flaps, urging the bottom side wall flaps inwardly, and the tucking assembly contacts the bottom trailing flap, urging the bottom trailing flap inwardly, over the bottom side wall flaps.

In a present folding assembly, the opposing rotating members are operably connected to the drive shaft by a transmission for changing a direction of rotational movement. The transmission can include a plurality of gears, such as bevel gears for changing the direction of rotation about 90 degrees.

The tucking assembly can includes a mount extending from the drive shaft and a blade disposed at an end of the mount. A preferred embodiment of the tucking assembly includes a roller at an end of the blade to reduce resistance of movement of the blade along the trailing flap.

A tab tucker can extend from the mount between the shaft and the blade. The tab tucker is used for tucking the sixth flap or tab that is included in certain types of carton blanks. A form, fill and seal packaging machine having the bottom folding assembly is also disclosed.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
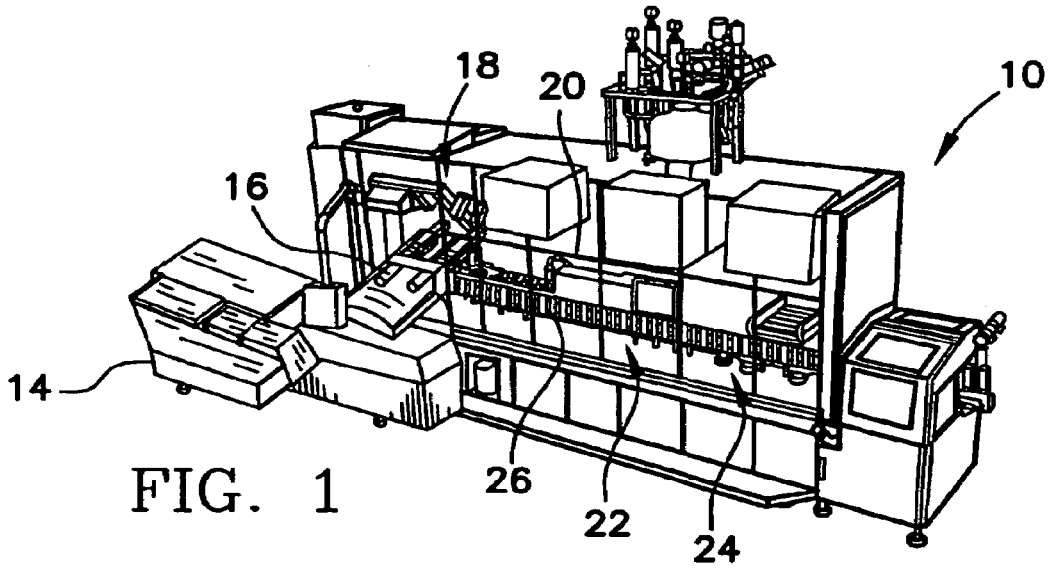
FIG. 1 is a perspective illustration of a form, fill and seal packaging machine having a carton bottom folding assembly embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures, and in particular to FIG. 1, there is shown a form, fill and seal packaging machine 10 that includes a bottom folding assembly 12 in accordance with the principles of the present invention. One example of a packaging machine 10 (without the present bottom folding assembly) is disclosed in U.S. Pat. No. 6,012,267 to Katsumata which patent is incorporated herein by reference.

The packaging machine 10 includes a carton magazine 14 for storing flat, folded carton blanks B, a carton erection station 16 and a bottom forming and sealing station 18. The bottom folding assembly 12 is formed as part of the bottom forming and sealing station 18.

The machine 10 can further include a sterilization station 20 for sterilizing the cartons C and further includes a filling station 22 at which the cartons C are filled with product. Following the filling station 22, the carton top panels are pre-folded and subsequently folded and sealed at a top folding and sealing station 24. The cartons C are then off loaded from the form, fill and seal packaging machine 10. The packaging machine 10 illustrated includes a conveyor 26 for transporting a series of cartons C to and through each of the stations.

At the bottom forming station 18, the bottom M of the carton C is heated, folded and sealed to produce an open-top carton with side walls and a sealed bottom. The open top carton C is placed on the conveyor 26 for transport at a predetermined rate, and moves in an indexed manner toward the right as viewed from the perspective of the machine illustrated in FIG. 1. The cartons C are typically disposed equidistantly from one another and advance a predetermined number of carton positions during each periodic advancing step (e.g., indexing) of the conveyor 26.

Between each advancing step of the conveyor 26, the cartons C generally remain stationary for processing for a predetermined period of time. This predetermined period of time generally corresponds to the slowest process on the line in the fabrication of the carton C. The slowest process is generally the sealing of the top of the carton C after the carton C is filled with a desired product. A carton C will await the predetermined period of time, and then proceed, in the indexed manner, on to the next station.

Figure 2A:
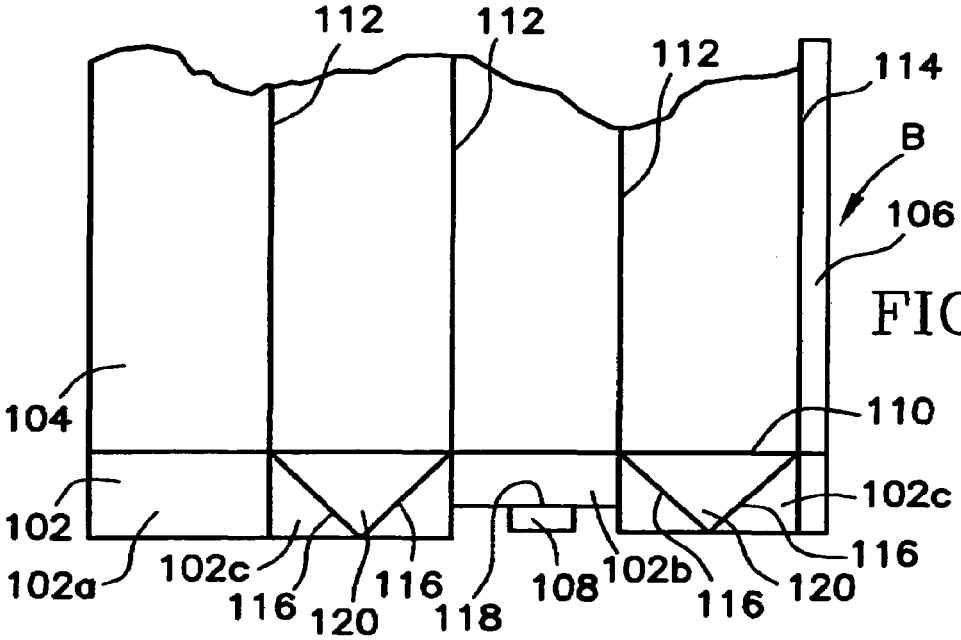
FIG. 2A is a partial plan view of an exemplary carton blank used in conjunction with the form, fill and seal packaging machine.
Figure 2B:
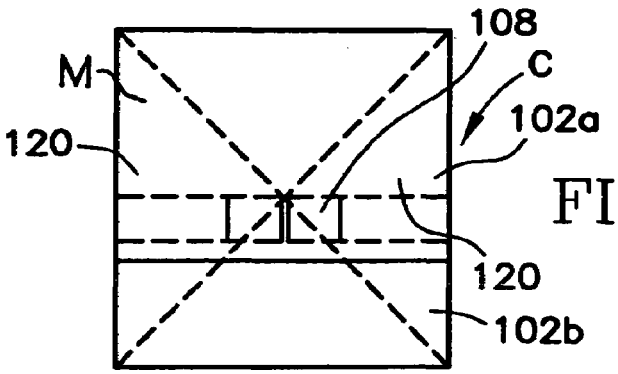
FIG. 2B is a partial bottom view of a carton bottom shown for reference.

Referring to FIG. 2, there is illustrated generally, the lower portion of a carton blank B that is configured for forming an overfolded bottom. The blank B has a plurality of bottom panels 102, a plurality of side panels 104, a sealing panel 106 and a sixth panel or tab 108. Each of the bottom panels 102 is partitioned from a corresponding side panel 104 by a horizontal score line 110. Each of the bottom panels 102 is partitioned from adjacent bottom panels by vertical score lines 112 (with vertical score line 114 partitioning bottom panel 102 from the sealing panel 106). One exemplary carton C is that disclosed in U.S. Pat. No. 6,328,204, to Stacy-Ryan, which patent is commonly assigned with the present application and is incorporated herein by reference.

The bottom panels 102 each have diagonal score lines 116 respectively, for folding the bottom panels 102 inward during the bottom forming process. The sixth panel or tab 108 is partitioned from bottom panel 102 by a horizontal score line 118. Although an overfolded carton blank B is illustrated, those skilled in the art will recognized that other carton blanks, including traditional TETRA REX® carton blanks, may be used with the present invention without departing from the scope and spirit of the present invention. It will also be recognized that the carton blank B can be of the type having an interior aluminum barrier layer.

Figure 3:
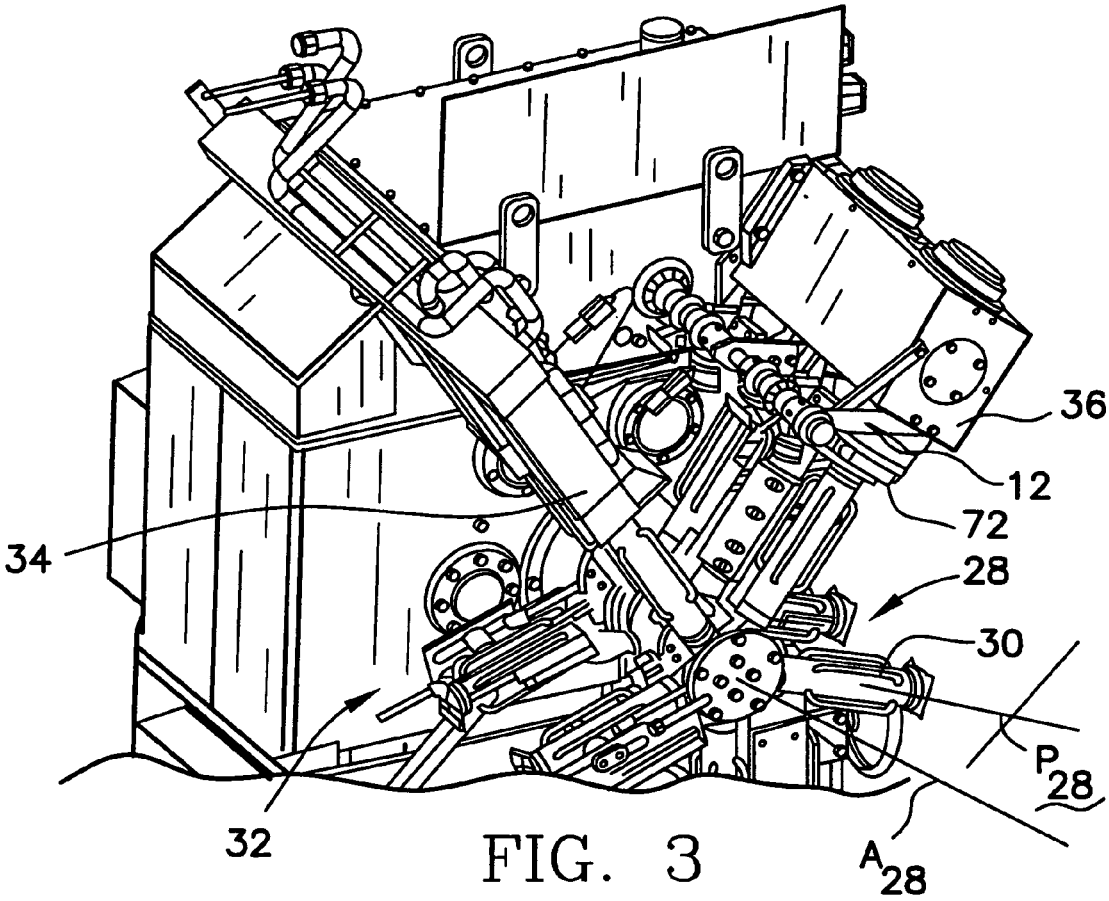
FIG. 3 is a partial perspective view of the interior of the packaging machine showing, in part, the folding assembly disposed between the carton bottom panel heaters and the bottom panel sealing station.

As shown in FIG. 3, the bottom forming station 18 includes generally, a turret 28 with mandrels 30 projecting therefrom. The turret 28 rotates about a fixed axis $A_{28}$ to rotate each of the mandrels 30 to sub-processing stations disposed about the turret 28.

The magazine 14 stores a plurality of carton blanks B and feeds erected carton blanks individually to a mandrel 30 at an infeed station 32. The erected carton blanks have the bottom panels 102 projecting outwardly from the mandrel 30 in order to heat, fold and seal the bottom panels 102 together to form the carton sealed bottom wall M.

Following carton C erection and placement on the mandrel 30, the carton C is indexed to the next sub-processing station, the heating station 34, in which the bottom panels 102 are heated for sealing. The bottom panels 102 are heated to a temperature that is about equal to the melting point of a thermoplastic coating that is formed on the carton blank B. A typical coating is a low density polyethylene.

The next station is the sealing station 36, in which the bottom panels 102 are sealed to one another. Mounted between the heating station and the sealing station is the novel folding assembly 12 of the present invention. The folding assembly 12, in conjunction with the sealer 36 facilitates forming a tight seal on each carton C that is processed at the bottom forming station 18. The final sub-processing station on the bottom forming station 18 is the discharge station, in which the carton C, with its newly sealed bottom wall M, is discharged to the conveyor 26 for further processing on the packaging machine 10.

Figure 4:
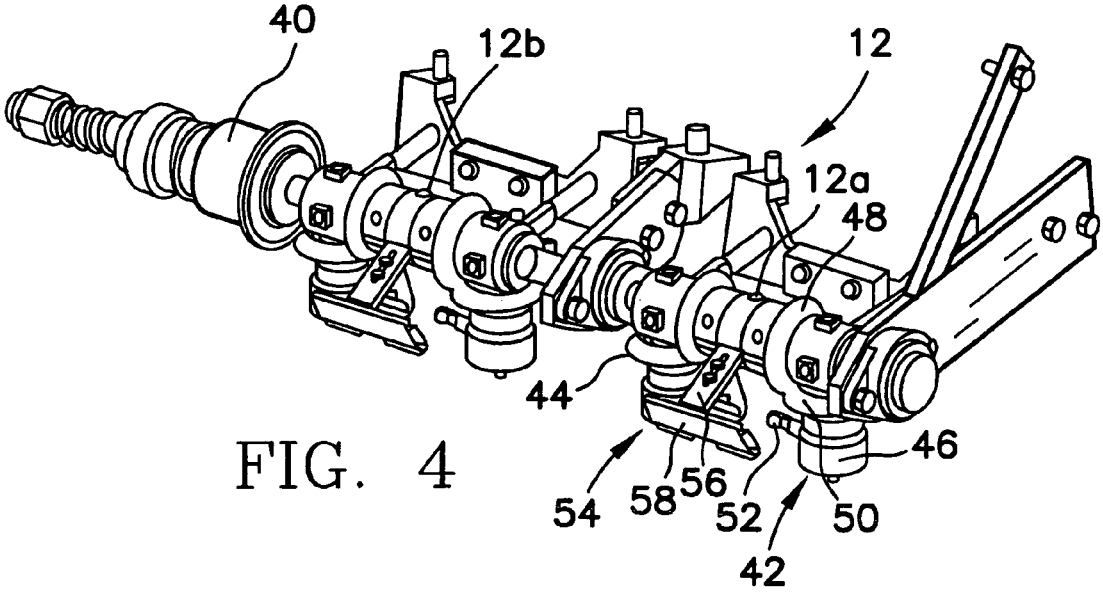
FIG. 4 is a perspective view of the folding assembly.
Figure 5:
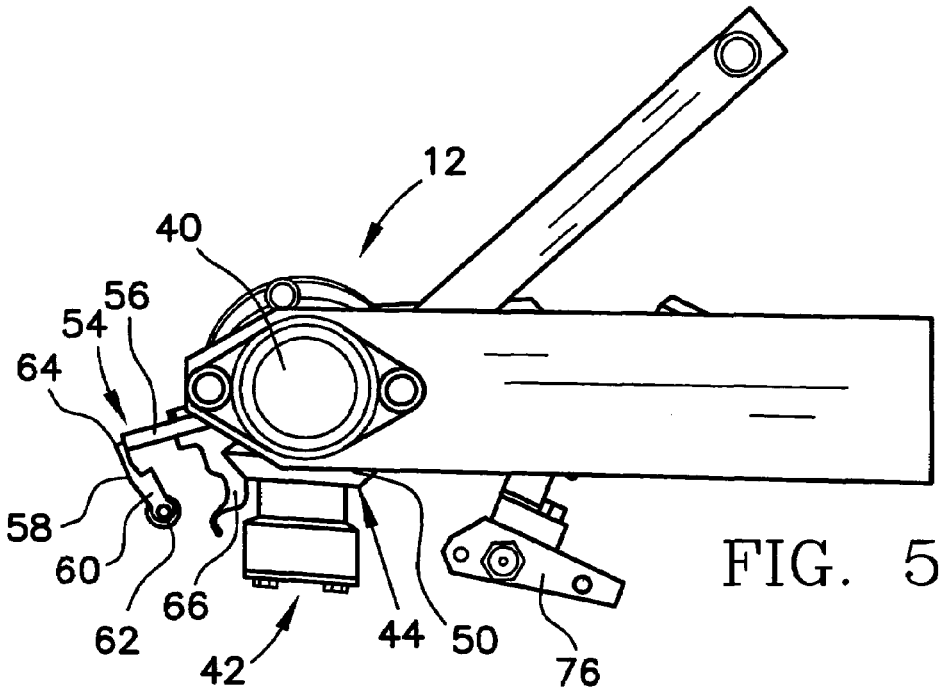
FIG. 5 is a side view of the folding assembly.

The bottom folding assembly 12 is configured to minimize the relative movement of the portions of the folding assembly 12 that contact the carton C. As seen in FIGS. 3 and 4, the folding assembly 12 includes a main drive shaft 40 that is oriented transverse to the plane $P_{28}$ defined by the rotational movement of the carton turret 28. The drive shaft 40 rotates to drive the folding assembly 12.

A pair of opposing, inwardly rotating finger assemblies 42 are operably mounted to and driven by, the drive shaft 40. The finger assemblies 42 each include a transmission 44 that reorients the rotational movement of the shaft 40. A spindle 46 is mounted to the transmission 44, transverse to the shaft 40. The spindle 46 is driven by the shaft 40 through the transmission 44. In a present embodiment the transmission 44 includes a pair of crown or bevel gears 48, 50. As will be appreciated by those skilled in the art, one gear 48 is mounted to the drive shaft 40 and meshes with the second gear 50 which is mounted to the spindle 46. A finger 52 extends radially from the spindle 46 to cross the path of the carton C as the carton C passes the folding assembly 12. As set forth above, each folding assembly 12 includes a pair of such fingers 52, with the fingers 52 opposing each other to contact the opposing sides of the passing carton C. In a present dual process packaging machine 10 (that forms, fills and seals two cartons in a side-by-side manner), two such folding assemblies 12*a*, 12*b* are mounted to a common drive shaft 40.

The folding assembly 12 further includes a tucking assembly 54 that is mounted to the shaft 40 between the finger assemblies 42. The tucking assembly 54 is mounted to the shaft 40 so as to rotate directly from and along with the shaft 40. The tucking assembly 54 includes a mount or extender 56 having an outer tucking blade 58 mounted thereto. The blade 58 has a leading end 60 that includes a roller or bearing 62 and a trailing end 64. The blade 58 is mounted to the folding assembly 12 so that it rotates along with the drive shaft 40 with the blade 58 rotating about the shaft 40.

Figure 6:
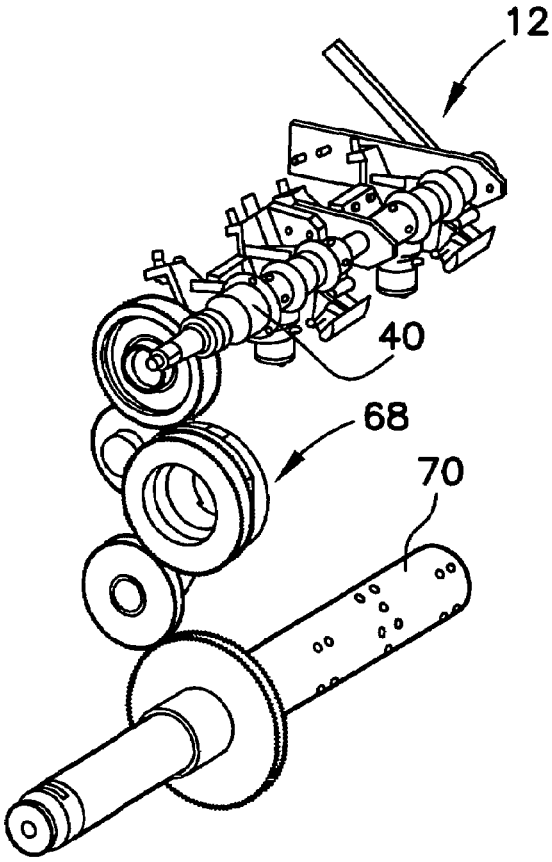
FIG. 6 is another perspective view of the folding assembly that shows the drive mechanism for the folding assembly.
Figure 7:
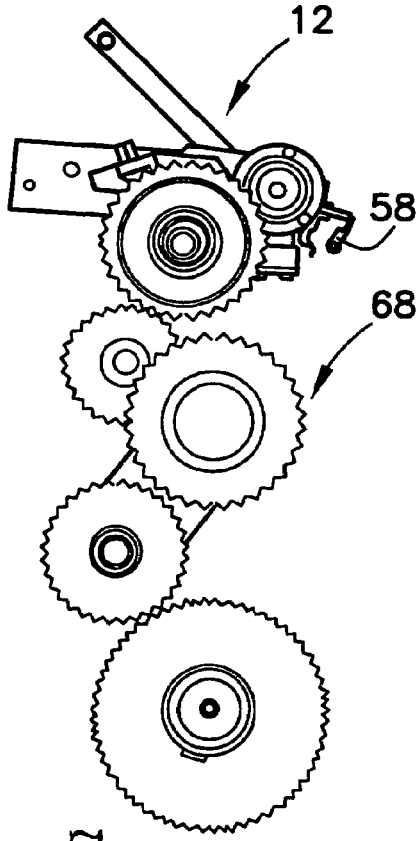
FIG. 7 is a side view of the folding assembly and drive mechanism.
Figure 8:
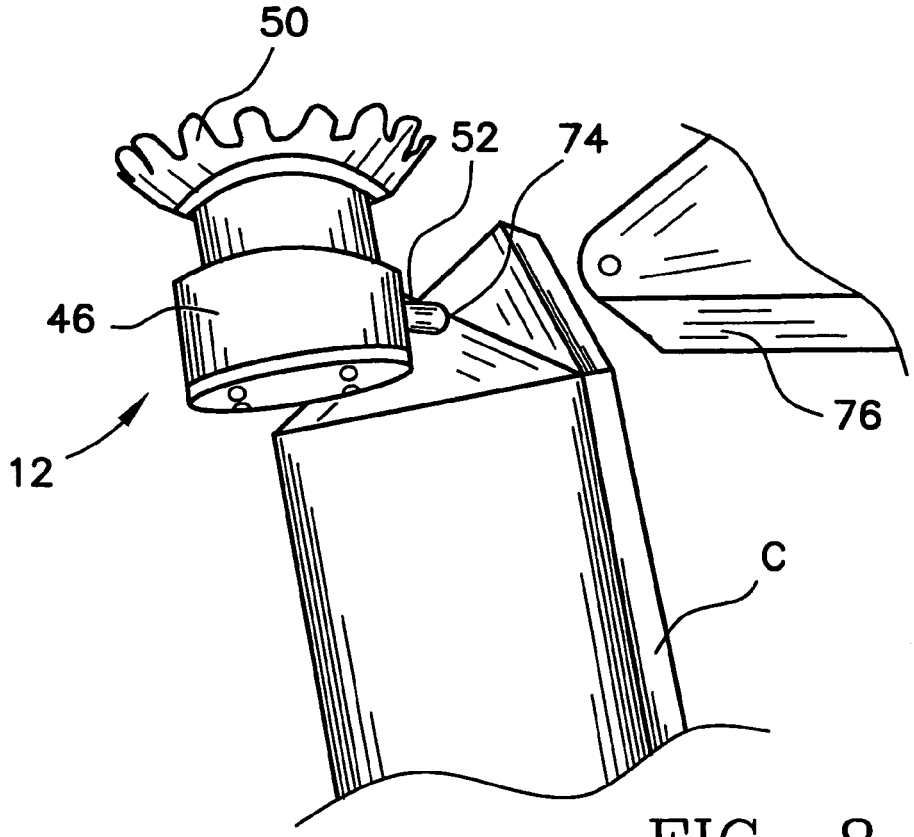
FIG. 8 is illustrates a carton passing through the folding assembly with the fingers in-folding the side panels.

The tucking assembly 54 can include a tab tucker 66. The tab tucker 66 is formed similar to the blade 58 and extends from the mount 56 between the shaft 40 and the outer tucking blade 58. The tab tucker 66 extends forwardly, that is in same direction as the blade 58, and serves as an inner tucking blade when used to form the bottom M of a carton C having a "sixth" panel or tab 108, such as that disclosed in the above-noted patent to Stacy-Ryan. As seen in FIGS. 6 and 7, the folding assembly drive shaft 40 is driven by a drive mechanism 68 that can include an indexing shaft 70 that is operably coordinated with the overall form, fill and seal machine 10.

In operation, prior to folding, a carton C that is loaded onto the mandrel 30 is indexed (i.e., rotated) to the bottom panel heaters 34. The heaters 34 heat the bottom panels 102 to soften the polymeric coating to prepare the panels 102 for folding and sealing.

The carton C is then indexed (rotated) toward the bottom sealing station 36, passing the bottom folding assembly 12. It should be noted that in the present machine 10, the carton C does not stop at the folding assembly 12, rather, it passes the folding assembly 12 as it moves toward (and stops at) the reciprocating bottom sealing plate 72.

As the carton C approaches the bottom folding assembly 12, the bottom panels 102 are essentially extending outwardly as an extension of the carton side wall panels 104. The bottom panels 102 include a leading panel 102*a*, as the first panel approaching the folding assembly 12, a trailing panel 102*b* (from which the tab 108, if present, extends) as the last panel approaching the assembly and a pair of side panels 102*c* that include triangular, in-folded panels 120.

As the carton C approaches the folding assembly 12, the blade 58 is out of the way, e.g., above, the carton C path, and the fingers 52 are out of the way, e.g., outside of, the carton C path, in that they have not yet rotated into the carton C path. As the carton approaches, the drive shaft 40 is timed so that the ends 74 of the fingers 52 contact an upper portion of the triangular panels 120, just at the point at which the length of the fingers 52 permit touching the carton C. That is, in that the fingers 52 are rotating and the carton C is moving between the rotating fingers 52, the fingers 52 contact the carton C when the triangular bottom panels 120 are just at the point at which the fingers 52 can touch or reach the carton C.

At this point, the blade 58 is rotating downward, toward the trailing panel 102*b*. As the blade 58 rotates down, because the panels 102 are still, to a great extent, extending "upwardly" from the side panels 104, the tab tucker 66 engages and "holds" the sixth panel or tab 108, essentially bending it backward. In this manner, rather than permitting the tab 108 to be positioned within the carton C adjacent an interior portion of the leading panel 102*a*, the tab 108 is "pulled" back so that it lies between the trailing panel 102*b* and the infolded side panels 102*c*. This configuration is intended to prevent any liquid within the package from contacting an uncoated or raw edge of the packaging material. Again, such a carton C configuration is disclosed in the aforementioned patent to Stacy-Ryan.

Figure 9:
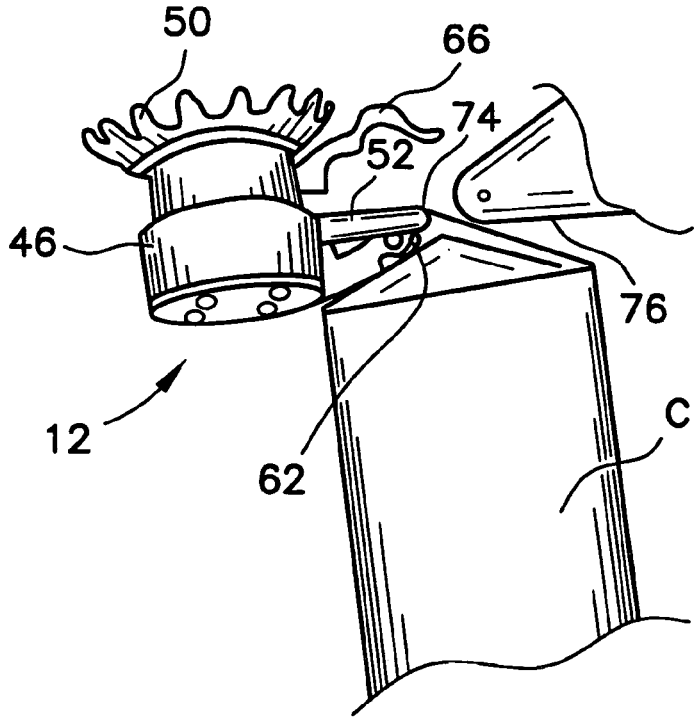
FIG. 9 is an illustration of the carton following that depicted in FIG. 8, showing the carton with the tucking blade positioned on the trailing panel, as the carton passes to the guide plate.

With the blade 58 continuing its downward movement and with the fingers 52 continuing inward rotation, the panels 102 are urged inward and downward to form the bottom wall M, essentially as seen in FIG. 9. As such, the tab or sixth panel 108 has "pulled" away from the tab tucker 66 and the blade 58 contacts the trailing panel 102*b*. This urges the panel 102*b* to fold inward. As the carton C continues toward the bottom sealing plate 72, it first engages a guide plate 76 that retains the panels 102 in the folded position as the carton C moves to the sealing plate 72. The guide plate 76 maintains the panels 102 infolded prior to sealing.

As set forth above, the cartons C are conveyed through the machine 10 at a predetermined velocity and the shaft 40 is timed to rotate so that the fingers 52 contact the carton bottom side panels 102*c* as the carton C approaches the "inlet" to the bottom folder 12. The shaft 40 rotational velocity is such that the tangential velocity of the tucking blade 58 is about equal to the linear velocity of the carton C. As such, the tucking blade 58 "contacts" the carton C as the carton C enters the folder 12 and, as the carton C continues to move through the folder 12, the tucking blade 58 remains in contact with the panel 102*b*, but does not substantially move (longitudinally) along the panel 102*b*. Thus, the tucking blade 58 essentially contacts a spot on the panel 102*b* and remains in contact with that spot as the carton C moves through the folding assembly 12. It has been found that such an arrangement reduces the amount of moving or sliding contact between the machine 10 parts and the carton C material. This, in turn, reduces the amount of dust that may otherwise be generated by contact of "moving" parts with the carton C material.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A form, fill and seal packaging machine for forming a package, filling the package and sealing the package, the package being formed from a plurality of upstanding side walls, each contiguous with its adjacent side walls, the carton including a bottom wall contiguous with the upstanding side walls, the bottom wall being formed from a plurality of bottom wall flaps including bottom side wall flaps, a bottom leading flap and a bottom trailing flap, the upstanding side walls defining an open top, and the bottom wall flaps defining an open bottom, the packaging machine comprising:

a carton magazine for storing a plurality of cartons, the cartons being in a flat folded form and having a longitudinal side seal;

a carton erection station for receiving the cartons and opening the cartons to a tubular form;

a rotating turret, the turret rotating to define a turret plane;

a plurality of carton mandrels mounted to the turret for rotation with the turret, each mandrel configured to receive a carton in the tubular form and to carry the carton, the carton positioned on the mandrel such that a bottom of the carton is positioned at a free end of the mandrel;

a carton bottom heater located along a rotational path of the turret;

a carton bottom sealer located along the rotational path of the turret;

a carton bottom panel folding assembly located along the rotational path of the turret, disposed between the carton bottom heater and the carton bottom sealer, the carton bottom panel folding assembly including a pair of opposing rotating members disposed on either side of the carton as the carton traverses passed the folding assembly, each of the rotating members configured to rotate in a plane that is transverse to the turret plane, the carton bottom panel folding assembly including a tucking assembly disposed between the opposing rotating members, the tucking assembly rotating in a plane transverse to the plane of the rotating members and parallel to the turret plane, the tucking assembly including a mount extending from the drive shaft and a blade disposed at an end of the mount, the blade having a roller mounted at an end thereof and including a tab tucker extending from the mount between the shaft and the blade, wherein the tab tucker and the blade are spaced from one another during a bottom trailing flap in-folding operation, wherein when a carton is positioned on the mandrel and passes the folding assembly, the opposing rotating members contact the bottom side wall flaps, urging the bottom side wall flaps inwardly and the tucking assembly contacts the bottom trailing flap, urging the bottom trailing flap inwardly, over the bottom side wall flaps, and wherein the tucking blade contacts a spot on the bottom trailing flap and maintains contact with the spot, substantially without sliding longitudinally from the spot, as the carton traverses passed the folding assembly.

2. The form, fill and seal packaging machine in accordance with claim 1 wherein the folding assembly includes a rotating drive shaft, wherein the opposing rotating members are operably connected to the drive shaft and wherein the tucking assembly is operably connected to the drive shaft.

3. The form, fill and seal packaging machine in accordance with claim 2 wherein the opposing rotating members are operably connected to the drive shaft by a transmission for changing a direction of rotational movement.

4. The form, fill and seal packaging machine in accordance with claim 3 wherein the transmission includes a plurality of gears.

5. The form, fill and seal packaging machine in accordance with claim 4 wherein the gears are bevel gears.

6. A bottom folding assembly for a packaging machine, the bottom folding assembly configured to infold the bottom side panels, leading panel and trailing panel of a carton for forming a sealed carton bottom, the packaging machine including a carton magazine for storing a plurality of cartons in a flat folded form, a carton erection station for receiving the cartons and opening the cartons to a tubular form, a rotating turret onto which the cartons are positioned, the turret rotating so as to define a turret plane, a plurality of carton mandrels mounted to the turret for rotation with the turret, each mandrel configured to receive the carton in the tubular form and to carry the carton with the carton positioned such that a bottom of the carton is positioned at a free end of the mandrel, a carton bottom heater located along a rotational path of the turret and a carton bottom sealer located along the rotational path of the turret, the bottom folding apparatus comprising:

a rotating drive shaft mounted transverse to the turret plane and spaced from a periphery of the turret path;

a pair of opposing rotating members disposed on either side of the rotational path of the turret and operably mounted to the drive shaft, each of the rotating members configured to rotate in a plane that is transverse to the turret plane; and a tucking assembly disposed between the opposing rotating members, the tucking assembly mounted to the drive shaft for rotating in a plane transverse to the plane of the rotating members and parallel to the turret plane, the tucking assembly including a mount extending from the drive shaft and a blade disposed at an end of the mount, the blade having a roller mounted at an end thereof and including a tab tucker extending from the mount between the shaft and the blade, wherein the tab tucker and the blade are spaced from one another during a bottom trailing flap in-folding operation, wherein when a carton is positioned on the mandrel and passes the folding assembly, the opposing rotating members contact the bottom side wall flaps, urging the bottom side wall flaps inwardly and the tucking assembly contacts the bottom trailing flap, urging the bottom trailing flap inwardly, over the bottom side wall flaps, and wherein the tucking blade contacts a spot on the bottom trailing flap and maintains contact with the spot, substantially without sliding longitudinally from the spot, as the carton traverses passed the folding assembly.

7. The bottom folding assembly in accordance with claim 6 wherein the opposing rotating members are operably connected to the drive shaft by a transmission for changing a direction of rotational movement.

8. The bottom folding assembly in accordance with claim 7 wherein the transmission includes a plurality of gears.

9. The bottom folding assembly in accordance with claim 8 wherein the gears are bevel gears.

* * * * *